US006837713B1

(12) United States Patent
Kough et al.

(10) Patent No.: US 6,837,713 B1
(45) Date of Patent: Jan. 4, 2005

(54) DUMMY PRACTICE GRENADE

(76) Inventors: Kayne K. Kough, K. K. Enterprises, Newville, PA (US) 17241-9602; Kenneth E. Kough, Jr., 147 Steelstown Rd., Newville, PA (US) 17241

( * ) Notice: Subject to any disclaimer, the term of this patent is extended or adjusted under 35 U.S.C. 154(b) by 0 days.

(21) Appl. No.: 10/657,563

(22) Filed: Sep. 9, 2003

(51) Int. Cl.[7] ..... F41A 33/00
(52) U.S. Cl. ..... 434/11; 102/498
(58) Field of Search ..... 434/11, 12, 14, 434/15, 16; 102/498

(56) References Cited

U.S. PATENT DOCUMENTS 2,817,294 A * 12/1957 Hjellnes ..... 102/361
3,085,509 A * 4/1963 Brandt ..... 102/445
3,156,187 A * 11/1964 Batou ..... 102/483
3,981,093 A 9/1976 Reed
4,498,396 A 2/1985 Bérubé
4,689,911 A 9/1987 White
5,129,325 A * 7/1992 Matzagg ..... 102/445
5,257,936 A * 11/1993 Ambrosi et al. ..... 434/11
5,259,319 A * 11/1993 Dravecky et al. ..... 102/447
6,575,098 B2 * 6/2003 Hsiung ..... 102/498

* cited by examiner

*Primary Examiner*—Kurt Fernstrom
(74) *Attorney, Agent, or Firm*—RIchard C. Litman

(57) ABSTRACT

The dummy practice grenade of the present invention is particularly useful as a rifle grenade with a rifle having a fixed grenade launching sight such as a Yugoslavian M59/66 SKS Military rifle using 7.62×39 mm grenade launching cartridges, while exhibiting high accuracy during use as well as a rugged, structure which is useful for a large number of launches. The inventive grenade is also useful with other rifles such as the M1 Garand Military Rifle in 30-06 Caliber with a grenade launching attachment, grenade launching sight and grenade launching cartridges. The inventive dummy grenade is made of high density plastic such as polyethylene, and aluminum, and is weighted in the nose cone portion with lead shot so as to provide directional stability to the grenade during flight. The present invention is useful in combat training and in competitive events requiring target acquisition accuracy.

10 Claims, 5 Drawing Sheets

DUMMY PRACTICE GRENADE

BACKGROUND OF THE INVENTION

1. Field of the Invention

The present invention relates to dummy rifle grenades for practice. More particularly, the present invention relates to a dummy rifle grenade useful with a rifle with a fixed grenade launching sight.

2. Description of the Related Art

The use of dummy practice rifle grenades is well known for training of military troops to sharpen their skills in launching grenades and hitting a target with the simulated grenade. Known practice rifle grenades suffer from damage during use and are generally useful for only one or a few launches. Certain rifles using rifle grenades have fixed sights and known practice rifle grenades are inaccurate when used with these rifles. One such rifle in present use is the Yugoslavian M59/66 SKS Military rifle using 7.62×39 mm grenade launching cartridges. It would be desirable to provide an accurate, reusable, accurate practice rifle grenade for use with this rifle. It would also be desirable to provide such a practice rifle grenade which is useful with other rifles such as a M1 Garand Military Rifle in 30-06 Caliber using a grenade launching attachment, grenade launching sight and grenade launching cartridges.

U.S. Pat. No. 3,156,187, issued Nov. 10, 1964, to Batou, describes a practice rifle grenade that has a metal body and plastic head and tail fins.

U.S. Pat. No. 5,257,936, issued Nov. 2, 1993, to Ambrosi et al., describes a practice grenade that utilizes plastics and metal in its construction.

U.S. Pat. No. 4,498,396, issued Feb. 12, 1985, to Bérubé, G., describes a practice warhead.

U.S. Pat. No. 3,981,093, issued Sep. 21, 1976, to Reed, describes a gas operated rifle grenade launcher.

U.S. Pat. No. 4,689,911, issued Sep. 1, 1987, to White describes a rifle grenade launcher attachment for an infantry rifle.

None of the above inventions and patents, taken either singly or in combination, is seen to describe the instant invention as claimed. Thus a dummy practice grenade solving the aforementioned problems is desired.

SUMMARY OF THE INVENTION

The dummy practice grenade of the present invention is particularly useful as a rifle grenade with a rifle having a fixed grenade launching sight such as a Yugoslavian M59/66 SKS Military rifle using 7.62×39 mm grenade launching cartridges, while exhibiting high accuracy during use as well as a rugged, structure which is useful for a large number of launches. The inventive grenade is also useful with other rifles such as the M1 Garand Military Rifle in 30-06 Caliber with a grenade launching attachment, grenade launching sight and grenade launching cartridges. The inventive dummy grenade is made of high density plastic such as polyethylene, and aluminum, and is weighted in the nose cone portion with lead shot so as to provide directional stability to the grenade during flight. The present invention is useful in combat training and in competitive events requiring target acquisition accuracy.

Accordingly, it is a principal object of the invention to provide a durable, accurate dummy practice grenade.

It is another object of the invention to provide a practice grenade as above for use with a rifle for launch.

It is a further object of the invention to provide a practice grenade as above which is accurate when used with a fixed-sight launching rifle.

Still another object of the invention is to provide a practice grenade which is made of inexpensive materials and is simple in construction.

Yet another object of the invention is to provide a practice grenade which is weighted to provide an accurate flight trajectory resulting in accurate acquisition of the target.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
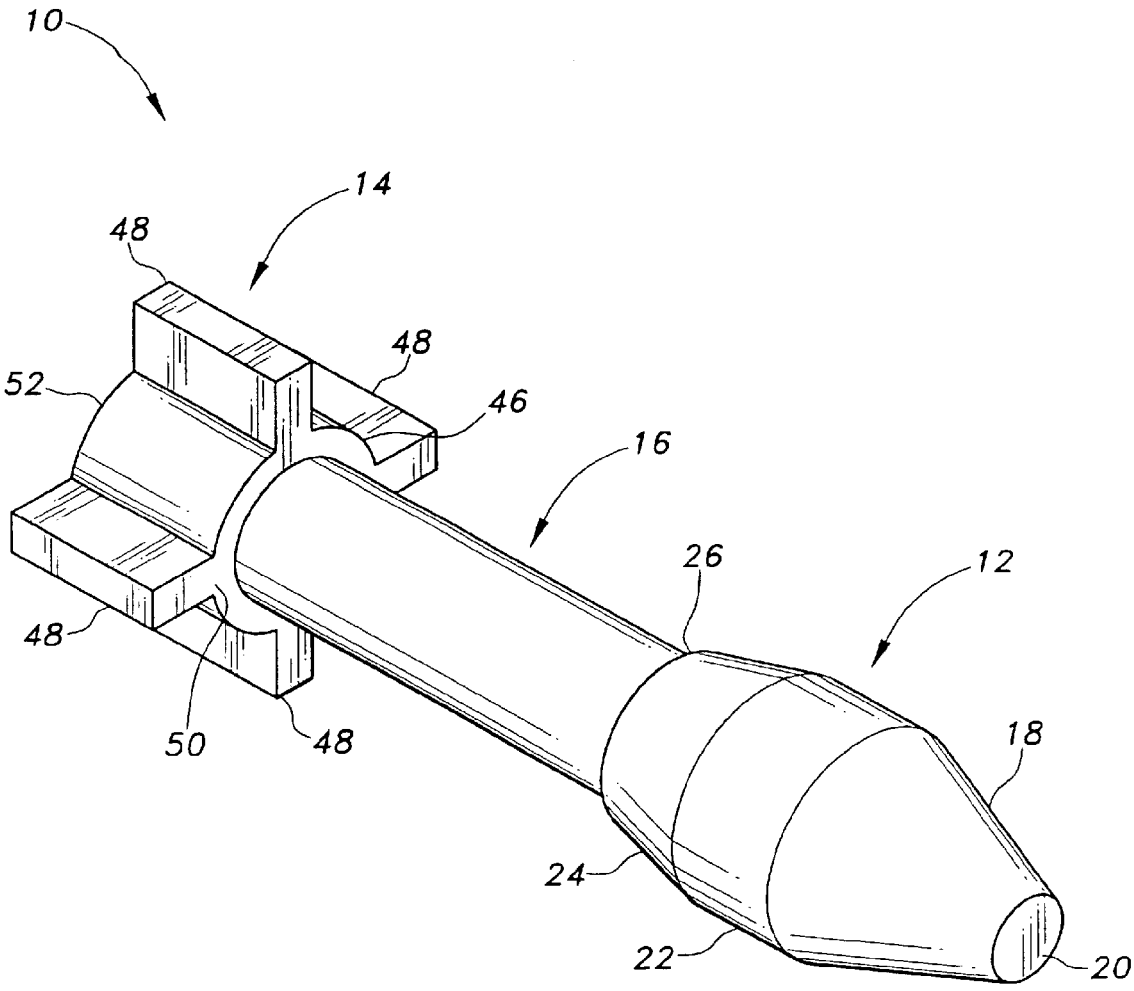
FIG. 1 is a perspective view of a dummy practice grenade according to the present invention.

The present invention is a dummy practice grenade. The inventive rifle grenade is particularly useful as a rifle grenade with a rifle having a fixed grenade launching sight such as a Yugoslavian M59/66 SKS Military rifle using 7.62×39 mm grenade launching cartridges, while exhibiting high accuracy during use as well as a rugged, structure which is useful for a large number of launches. The inventive grenade is also useful with other rifles such as the M1 Garand Military Rifle in 30-06 Caliber with a grenade launching attachment, grenade launching sight and grenade launching cartridges. The inventive dummy grenade is made of high density plastic such as polyethylene, and aluminum, and is weighted in the nose cone portion with lead shot so as to provide directional stability to the grenade during flight. The present invention is useful in combat training and in competitive events requiring target acquisition accuracy.

Referring to the Figures, there is shown a dummy practice grenade generally designated reference no. 10. The grenade 10 of the present invention has a generally cylindrical nose cone 12 and a radially finned tail 14 separated by a cylindrical body 16 and attached thereto and sharing a central axis therewith. The nose cone 12 and the tail 14 are preferably made of high-density polyethylene and the cylindrical body 16 is preferably made of aluminum.

Figure 2:
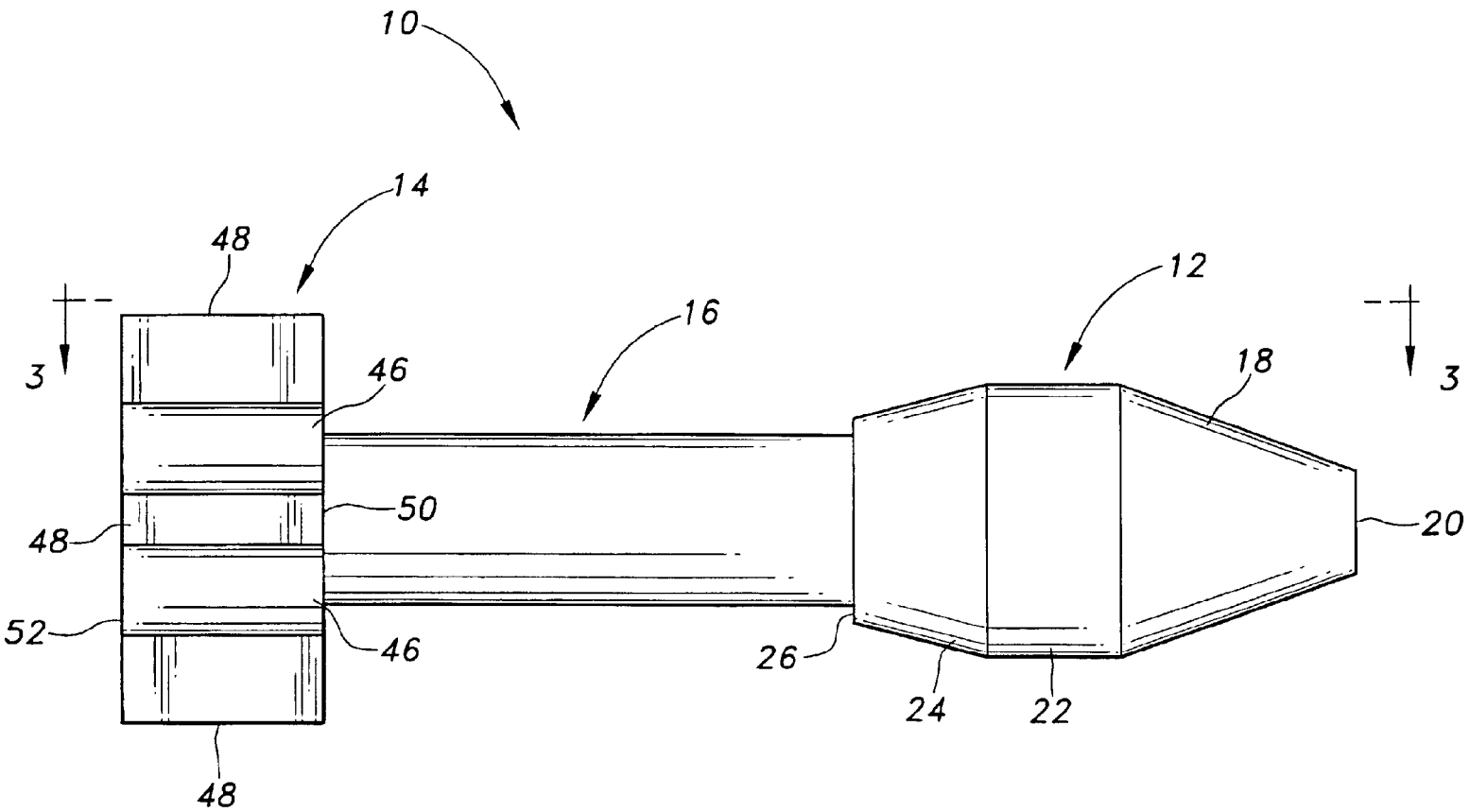
FIG. 2 is an elevational view of the dummy rifle grenade of FIG. 1.
Figure 3:
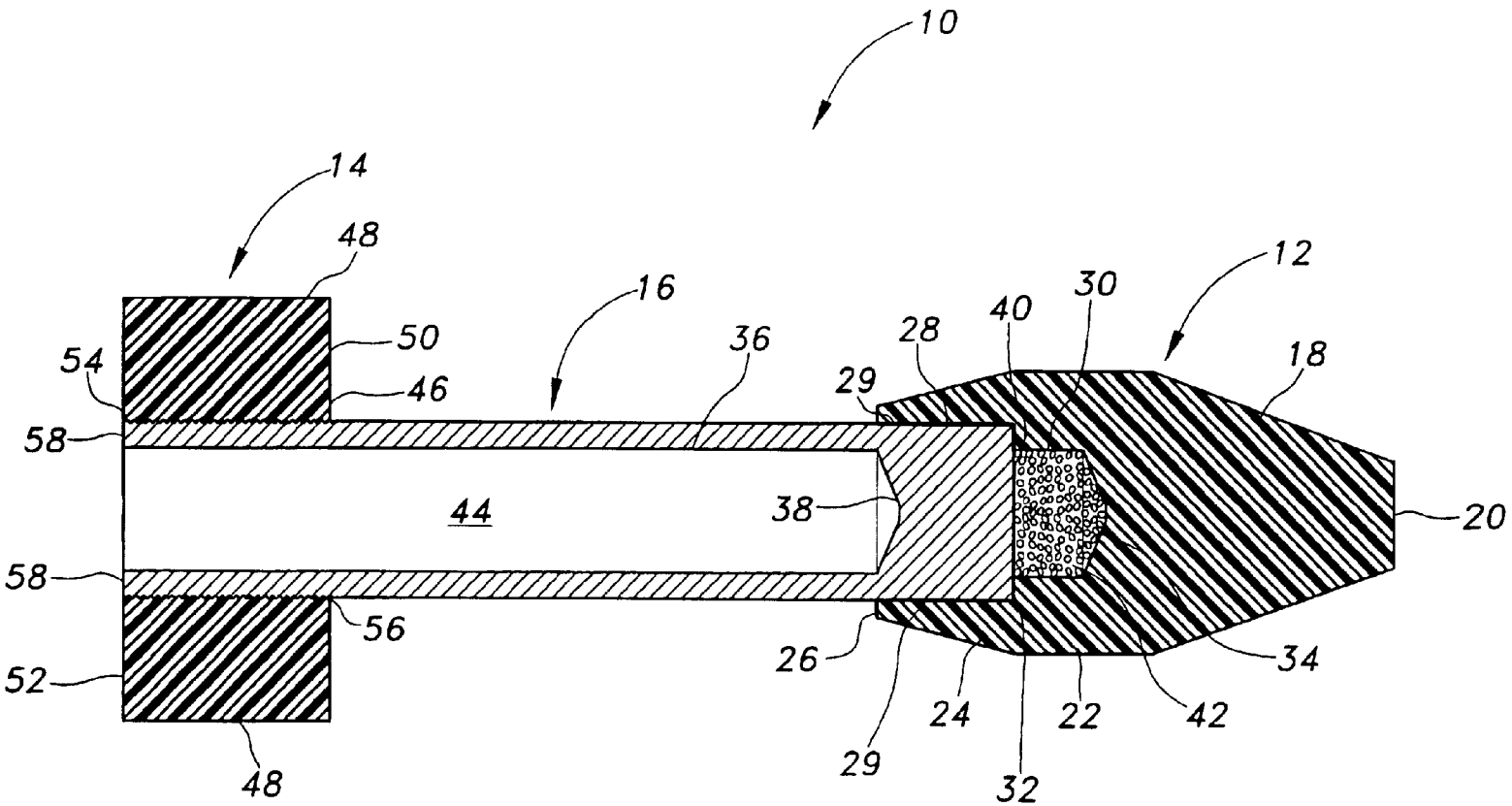
FIG. 3 is a sectional view taken along lines 3—3 of FIG. 2.
Figure 4:
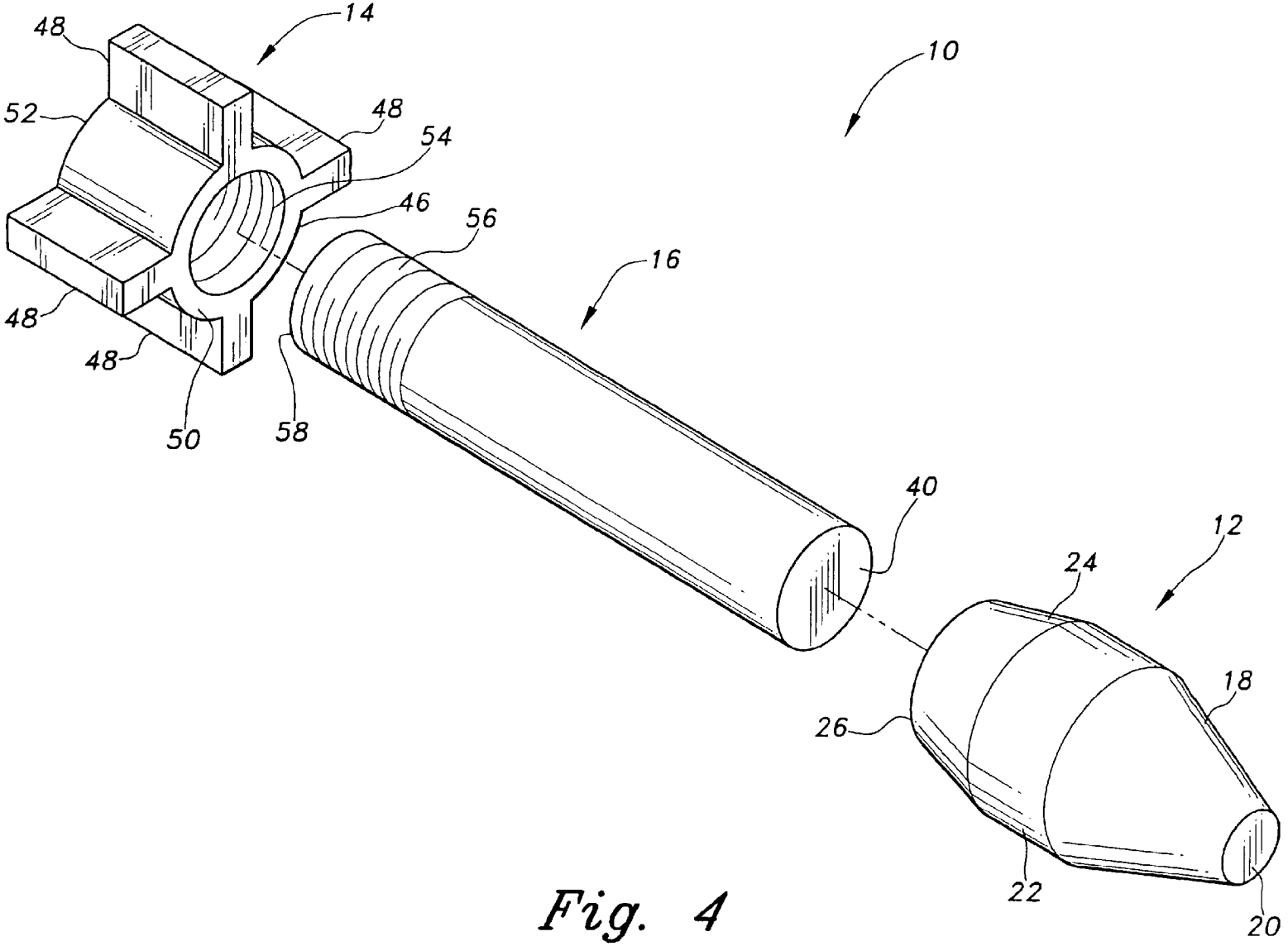
FIG. 4 is an exploded view of the dummy rifle grenade of FIG. 1.
Figure 5:
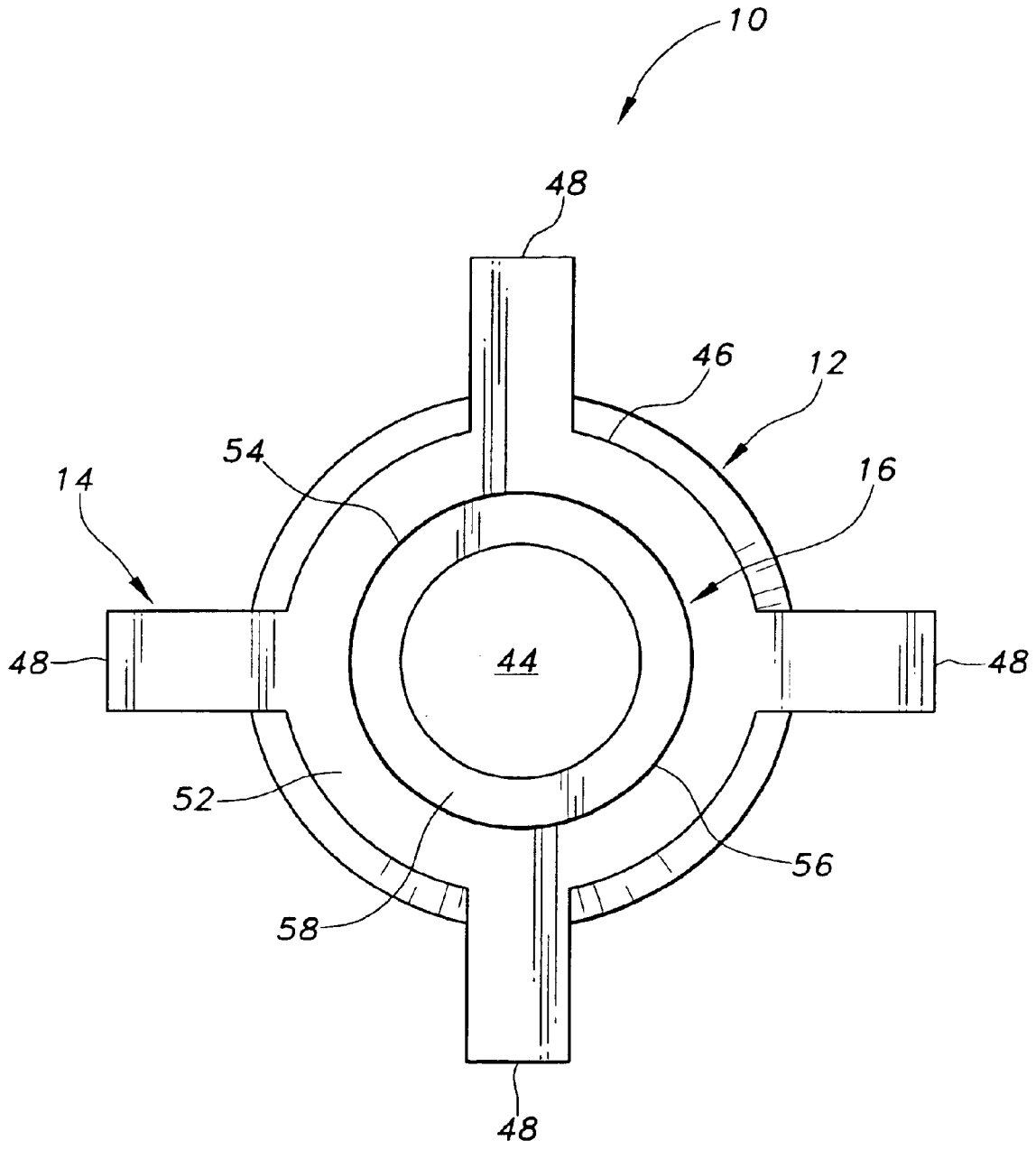
FIG. 5 is an elevational view of the tail end of the dummy rifle grenade of FIG. 1.

Referring more particularly to FIGS. 2 and 3, nose cone 12 has a front cone portion 18 tapering inward to a front flat 20. Nose cone 12 has a central cylindrical portion 22, and a nose cone inner taper portion 24, tapering rearwardly inward from central cylindrical portion 22 and ending with a nose cone rear flat 26 extending radially inward toward cylindrical body 16 as assembled. Nose cone 12 has a rear axial bore 28 receiving the front portion of cylindrical body 16. Axial bore 28 extends forward, opening into nose cone central axial bore 30 of smaller diameter forming cone inner step 32. Central axial bore 30 extends forward to axial bore front wall 34.

Cylindrical body 16 has a front portion, a central portion, and a rear portion, the front portion being inserted into nose cone rear axial bore 28. Cylindrical body 16 is a rod having an axial bore 36 extending from its tail to a point about even with nose cone rear flat 26 when fully inserted into the nose cone, i.e., extending the length of the front portion into nose cone 12 so as to rest its forward wall 40 against cone inner step 32, thus forming an inner volume 42 within nose cone central cylindrical portion 22 and acting as lead shot container for forward weighting dummy practice rifle grenade 10, the lead shot placed within being selected to form a desired center of gravity of the dummy practice grenade 10. The lead shot contained in inner volume 42 may be adjusted for desired balance and flight characteristics of grenade 10 for obtaining the desired accuracy of the grenade launch. The nose cone 12 is affixed to the front portion of cylindrical body 16 by an adhesive layer 29 between the cylindrical body 16 and rear axial bore 28.

Cylindrical body axial bore 36 acts as a launcher receiver for receiving the launching rifle barrel nose end or launching attachment as is well known in the launching of rifle grenades.

Tail 14 has an axial cylindrical tail portion 46 having four tail fins 48, each extending outward and spaced 90 degrees around tail portion 46. Tail 14 has a front surface 50 and a rear surface 52, each being perpendicular to tail portion 46. Axial cylindrical tail portion 46 has tail attachment threads extending along its length on its inner side which threadingly engage tail receiving threads 56 cut on the rear portion of cylindrical body 16 when tail 14 is mounted on cylindrical body 16 for launching. Cylindrical body 16 has rear annular end wall 58 extending between axial bore 36 and tail receiving threads 56, the end wall 58 being located even with tail rear surface 52 or spaced forward therefrom as desired.

The tail 14 is removably mounted on cylindrical body 16 by screwing thereon by means of engaging threads 54 and 56. The nose cone is permanently attached to the cylindrical body in its assembled position by a non-hardening adhesive.

In operation, dummy practice rifle grenade 10 is mounted on the launching rifle, the rifle aimed at a target, and a launching cartridge activated in the chamber of the rifle, thus launching the practice grenade toward its target. The dummy practice rifle grenade of the present invention has the demonstrated capability of hitting within 1 ft. of the target from a range of 150 yards and remain usable for a substantial number of launches.

The desired dimensions of a the assembled practice rifle grenade are as follows: overall length, 9¼ inches; overall nosecone length, 3¾ inches; front flat diameter, ¾ inch; front cone portion length, 1¾ inches; nose cone central cylindrical portion, 2 inches in diameter and 1 inch in length; nose cone inner taper portion, 1 inch in length; nose cone diameter at nose cone rear flat, 1½ inches; nose cone rear axial bore, 1 inch in length and 1¼ inches in diameter; nose cone central axial bore, ½ inch in length and ⅞ inch diameter; cylindrical body overall length, about 6½ inches; cylindrical body axial bore, ⅞ inch in diameter and 5½ inch in length; tail length between front and rear surfaces, 1½ inches; tail cylindrical portion diameter, 1¾ inches; tail fin length, 1½ inches; and tail fin thickness, ⅜ inch. The tail attachment and receiving threads are 1¼" by 7.

The preferred materials are 6061 aluminum for the cylindrical body and high-density polyethylene plastic for the nose cone and tail. Other suitable materials are substituted, therefor.

It is to be understood that the present invention is not limited to the embodiment described above, but encompasses any and all embodiments within the scope of the following claims.

We claim:

1. A dummy practice rifle grenade, comprising:

a generally cylindrical nose cone having a central axis;

a cylindrical body having a central axis and having a front portion having a perpendicular front wall, a central portion, and a rear portion having a perpendicular rear wall; and a finned tail;

said nose cone having a front cone portion tapering axially inward to a front flat perpendicular to said axis, a central cylindrical portion extending rearwardly from said front cone portion, and an inner taper portion extending rearwardly from said central cylindrical portion and tapering axially inwardly to a rear flat perpendicular to said axis;

said nose cone having a rear opening rear axial bore having a first diameter extending forward to the intersection of said cylindrical portion and said inner taper portion, and having a central axial bore having a second diameter smaller than said first diameter opening into said rear axial bore and extending forward to a front wall located within said central cylindrical portion, said rear axial bore and said central axial bore forming a cone inner step disposed perpendicular to said axis;

said cylindrical body front portion extending into said nose cone along said rear axial bore and affixed thereto, said front wall resting against said cone inner step forming a volume defined by said cylindrical body front wall, said central axial bore, and said central axial bore front wall, said volume containing lead shot;

said cylindrical body rear portion and central portion having a rear opening axial bore extending therethrough of such diameter as to receive a launching rifle nose;

said finned tail having a cylindrical portion coaxial with said cylindrical body and having a front surface and a rear surface and having a plurality of radially extending outward therefrom;

said tail cylindrical portion extending over said rear portion of said cylindrical body and affixed thereto.

2. The practice grenade of claim 1, wherein said finned tail cylindrical portion and said cylindrical body rear portion have mutually engaging threads for removably affixing said finned tail cylindrical portion to said cylindrical body.

3. The practice grenade of claim 2, wherein said finned tail has four fins equally radially spaced around said cylindrical tail portion.

4. The practice grenade of claim 3, wherein said lead shot is selected to provide a center of gravity at a desired point along the length of said grenade.

5. The practice grenade of claim 4, wherein said nose cone is affixed to said front portion of said cylindrical body by an adhesive material.

6. The practice grenade of claim 5, wherein the overall length of the practice grenade is 9¼ inches.

7. The practice grenade of claim 6, wherein the overall nosecone length is 3¾ inches; the front flat diameter is ¾ inch; the front cone portion length is 1¾ inches; the nose cone central cylindrical portion is 2 inches in diameter and 1 inch in length; the nose cone inner taper portion is 1 inch in length; the nose cone diameter at nose cone rear flat is 1½ inches; the nose cone rear axial bore is 1 inch in length and 1¼ inches in diameter; the nose cone central axial bore is ½ inch in length and ⅞ inch diameter, the cylindrical body overall length is about 6½ inches; the cylindrical body axial bore is ⅞ inch in diameter and 5½ inches in length; the tail length between front and rear surfaces is 1½ inches; the tail cylindrical portion diameter is 1¾ inches; the tail fin length is 1½ inches; and the tail fin thickness is ⅜ inch.

8. The practice grenade of claim 2, wherein said tail attachment and receiving threads are 1¼ inch by 7.

9. The practice grenade of claim 1, wherein said nose cone and said tail are made of a plastic material and said cylindrical body is made of aluminum.

10. The practice grenade of claim 9, wherein said plastic material is a high-density polyethylene and said aluminum is 6061 aluminum.

* * * * *